US007918079B2

(12) United States Patent
Bloch

(10) Patent No.: US 7,918,079 B2
(45) Date of Patent: Apr. 5, 2011

(54) ROPE WITH A CORE AND A CASING SURROUNDING THE CORE

(76) Inventor: Klaus Bloch, Sankt Augustin (DE)

( * ) Notice: Subject to any disclaimer, the term of this patent is extended or adjusted under 35 U.S.C. 154(b) by 149 days.

(21) Appl. No.: 12/315,628

(22) Filed: Dec. 4, 2008

(65) Prior Publication Data

US 2009/0217640 A1 Sep. 3, 2009

(51) Int. Cl.
*D02G 3/02* (2006.01)
*D02G 3/22* (2006.01)

(52) U.S. Cl. ..... 57/210; 57/231

(58) Field of Classification Search ..... 57/210, 57/230, 231; 87/6, 7
See application file for complete search history.

(56) References Cited

U.S. PATENT DOCUMENTS

| | | | | |
|---|---|---|---|---|
| 5,802,828 | A | 9/1998 | Adorno | |
| 7,168,231 | B1 * | 1/2007 | Chou et al. | 57/210 |
| 7,401,460 | B2 | 7/2008 | Bloch | |
| 2006/0048497 | A1 * | 3/2006 | Bloch | 57/230 |

FOREIGN PATENT DOCUMENTS

DE 103 28 919 B4 1/2005

* cited by examiner

*Primary Examiner* — Shaun R Hurley
(74) *Attorney, Agent, or Firm* — Pauley Petersen & Erickson

(57) ABSTRACT

A rope with a core and a casing surrounding the core. The core is composed of a multitude of synthetic fibers and the casing is composed of a multitude of synthetic fibers that are interlaced with one another. The synthetic fibers that form the casing are composed of polytetrafluoroethylene and form a lightproof and fluid-repellent envelope for the core.

15 Claims, 1 Drawing Sheet

ROPE WITH A CORE AND A CASING SURROUNDING THE CORE

BACKGROUND OF THE INVENTION

1. Field of the Invention

This invention relates to a rope with a core and a casing surrounding the core which is of a multitude of synthetic fibers and the casing is of a multitude of synthetic fibers that are interlaced with one another.

2. Discussion of Related Art

A wide variety of cores of the type mentioned above are known and are frequently manufactured in the form of an interlaced casing of polyester, polyamide, or polypropylene fibers.

When ropes of this kind are used in outdoor applications, they are exposed to environmental conditions without protection. Powerful solar radiation, in particular due to the UV radiation that it contains, has a very negative impact on the fatigue durability of such ropes and causes them to wear rapidly and require replacement. The service life and usability of known ropes tend to decrease rapidly when the ropes are used in chemically aggressive media.

On the other hand, yarns have been disclosed, such as by U.S. Pat. No. 5,802,828, which have an interlaced casing of PTFE and are used as caulking strips or pump packing strips. Yarns of this kind, however, have only low strengths, in particular only a low tensile strength.

SUMMARY OF THE INVENTION

One object of this invention, is to provide a rope of the type mentioned above but which offers a high degree of flexibility and knot tenacity while simultaneously having an extremely high tensile strength, and also a maximal insensitivity to external influences such as solar radiation or chemically aggressive materials.

To achieve the object, this invention provides a rope according to the defining characteristics described in this specification and in the claims.

In one embodiment according to this invention, the synthetic fibers that comprise the casing are composed of polytetrafluoroethylene (PTFE) and form a lightproof and fluid-repellent envelope for the core.

PTFE is distinguished by a surprising resistance to UV light as well as an extremely low sensitivity to chemically aggressive media. In the context of this invention, synthetic fibers produced from PTFE can be used in conventional interlacing patterns as a casing of an interlaced rope and can reliably protect the core of an interlaced rope thus produced from the penetration of UV radiation.

In addition, PTFE has moisture-repellant properties. Thus, the casing of interlaced PTFE fibers according to this invention almost completely prevents the penetration of fluids, such as chemically aggressive media, into the core region of the rope according to this invention so that the core can be reliably protected from a corresponding attack of the chemically aggressive medium.

Depending on the type of synthetic fiber and interlacing used for the casing, it is possible to achieve up to a 100% seal of the core in relation to chemically aggressive media.

To this extent, the embodiment proposed according to this invention makes it possible to use a core of high-tensile-strength synthetic fibers such as PTFE, aramide fibers, PBO Zylon®, or also a polyethylene with an ultra-high molecular weight, such as having only an extremely low resistance to UV radiation and chemically aggressive media. If, however, such fibers forming a core are surrounded in the manner according to this invention by a casing based on interlaced PTFE-based synthetic fibers, then neither service life-reducing UV radiation nor chemically aggressive media can attack the core of the rope according to this invention to any relevant extent.

With the embodiment proposed according to this invention, it is thus possible to manufacture extremely high-tensile-strength, resistant ropes because it is possible to return to using materials for the synthetic fibers of the core that do in fact have the best mechanical properties for the desired application, but have long been deemed unsuitable for such applications due to their low resistance to UV radiation and chemically aggressive media.

Because PTFE fibers are usually obtained from corresponding PTFE films by cutting the films into narrow strips, one embodiment according to this invention offers the possibility of the synthetic yarns that comprise the casing being composed of a multitude of individual PTFE fibers that are twisted together. For example, in one embodiment proposed according to this invention, the synthetic yarns that comprise the casing are each made up of 30 such individual PTFE fibers with a fiber thickness of 380 dtex.

The casing can then be composed of a multitude of such synthetic yarns that are interlaced with one another, for example 16 of these synthetic fibers.

In one embodiment of this invention, the core of the rope according to this invention can likewise be composed of synthetic fibers based on polytetrafluoroethylene (PTFE). However, because according to this invention, the casing constitutes a lightproof and fluid-proof envelope for the core, it is also possible to use non-UV-resistant, but high-strength materials, such as aramide fibers such as Kevlar®, fibers composed of PBO Zylon®, or also polyethylenes with an ultra-high molecular weight, such as of the type marketed by the company DSM under the brand name "Dyneema®".

Dyneema® fibers offer surprising tensile strengths with extremely low ultimate elongations and when used for the core, can thus produce ropes that are distinguished by extremely high tensile strengths, with the casing composed of lightproof and fluid-proof interlaced PTFE fibers, assuring extremely high resistance to UV radiation and/or chemically aggressive media.

Fibers composed of PBO Zylon® are produced from poly (p-phenylene-2,6-benzobisoxazole) and likewise demonstrate surprising strengths.

According to one embodiment of this invention, it is possible to use reasonably priced, but UV radiation-sensitive materials such as polypropylene, polyethylene, polyamide, and polyester to form the core. The PTFE casing significantly extends the service life of even these materials.

The synthetic fibers comprising the core can preferably be composed of a yarn thickness of 250 to 3,300 dtex, particularly for the synthetic fibers comprising the core to each be individually twisted with 200 to 700 turns/m in a first rotation direction around their longitudinal axis and then for a plurality of such individually twisted synthetic fibers to be twined together with 100 to 200 turns/m in the opposite rotation direction around their longitudinal axis.

In the case in which the core is composed of PTFE synthetic fibers, their yarn thickness is preferably 380 to 440 dtex.

In particular, it is possible for the core of the rope according to this invention to be composed of 540 individually twisted synthetic fibers, 30 to 180 of which are then twined together in the opposite rotation direction.

When the core is of PTFE synthetic fibers, the minimum strength of the fibers comprising the core is approximately 40 N per 1,000 denier of fiber thickness and the ultimate elongation is at most 8%.

If Dyneema® fibers are used for the core, the minimum strength is approximately 300 N per 1,000 denier of fiber thickness and the ultimate elongation is at most 3%.

A rope according to this invention preferably has a diameter from 2 to 20 mm, but can also have a smaller or significantly larger diameter, as needed.

With the interlaced, PTFE synthetic fiber-based casing according to this invention, the rope according to this invention also demonstrates above-average sliding properties and, due to the twisting and twining, also demonstrates extremely high wear resistance, making it unnecessary to provide lubrication.

BRIEF DESCRIPTION OF THE DRAWING

This invention is explained in greater detail in view of an exemplary embodiment in conjunction with the drawing, which is a schematic perspective depiction of a rope, which has a core and a casing that surrounds the core.

DETAILED DESCRIPTION OF THE INVENTION

Figure 1:
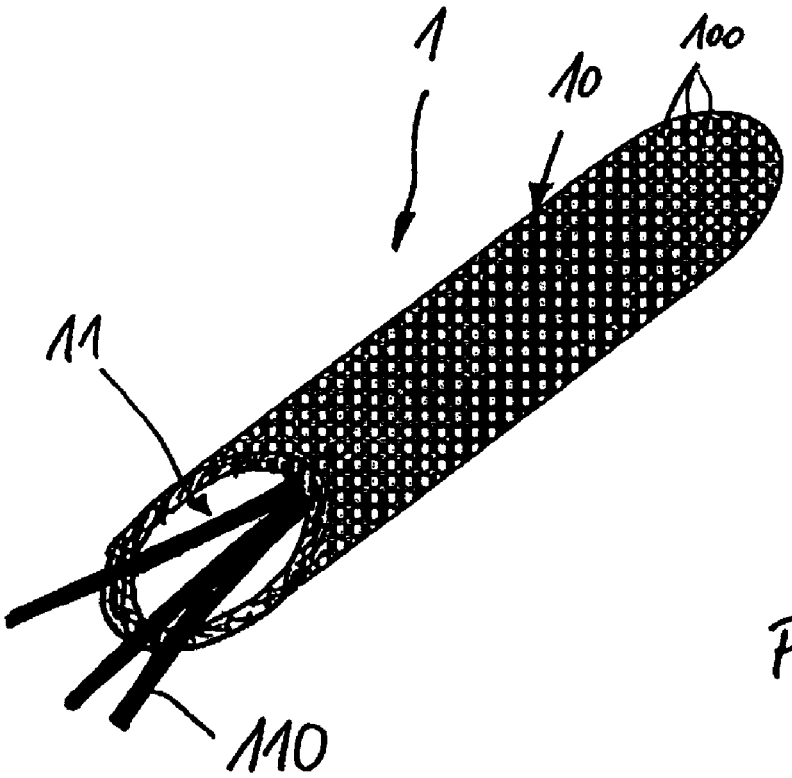

In order to achieve high strength accompanied by extremely high resistance to UV light and chemicals, the core 11 of rope 1 is produced out of polytetrafluoroethylene-based individual fibers 110. Such fibers 110 composed of or comprising PTFE are usually cut from a film in narrow strips. In the embodiment described, 540 such PTFE fibers with a yarn thickness of 380 dtex are used to form the core 11 so that the core 11 has a total yarn thickness of approximately 205,200 dtex. Each of the individual synthetic fibers 110 is first twisted with up to 700 turns/m in a first rotation direction around its longitudinal axis and then up to 180 of the twisted individual fibers, in this case 30 of them, are then combined and twined together in the opposite rotation direction, such as with 150 turns/m. This individual twisting and subsequent twining improves the suppleness and volume of the core 11.

The core 11 thus produced is externally enveloped by a casing 10 that forms or constitutes a lightproof, in particular UV lightproof, and virtually fluid-proof envelope for the core 11 so that no UV radiation and at most, only extremely small quantities of chemically aggressive media can come into contact with the core 11.

The casing 10 is also composed of or comprises synthetic polytetrafluoroethylene (PTFE)-based fibers, which are interlaced in a suitable fashion to produce the casing 10.

For example, the interlaced yarns 100 of the casing 10 can each be composed of or comprise 30 individual fibers with a yarn thickness of 380 dtex, and a total of 16 such synthetic yarns, each composed of 30 individual fibers, is used for the interlacing of the casing 10 so that a total yarn thickness of approximately 182,400 dtex (16×30×380 dtex) is achieved.

This embodiment yields a total rope thickness of approximately 8 mm, with each of the individual PTFE fibers used having a yarn thickness of 380 dtex and a strength of approximately 14 N.

In lieu of embodying the core 11 out of PTFE fibers, it is also possible to consider an analogous embodiment of the core 11 out of aramide fibers such as Kevlar® fibers, PBO Zylon®, or also ultra-high molecular weight polyethylene. Such materials are not especially resistant to chemically aggressive media and/or UV radiation, but the interlaced casing 10 composed of or comprising PTFE synthetic fibers 100 that constitutes a lightproof and virtually fluid-proof envelope reliably protects this vulnerable, yet simultaneously high-tensile-strength core from the influence of damaging UV radiation and/or aggressive media so that such a rope, despite its extreme tensile strength, is able to achieve a long service life even in a harsh environment.

The entire disclosure of U.S. Provisional Patent Application 61/005,834, filed on 7 Dec. 2007, in its entirety, is incorporated into this specification by reference thereto.

What is claimed is:

1. A rope (1) having a core (11) and a casing (10) surrounding the core (11), the core (11) being of a multitude of synthetic fibers (110) and the casing (10) being of a multitude of synthetic yarns (100) interlaced with one another, the rope (1) comprising the synthetic yarns (100) forming the casing (10) composed of polytetrafluoroethylene (PTFE) and forming a lightproof and fluid-repellent envelope for the core (11), the synthetic yarns (100) that form the casing (10) are each of a multitude of individual PTFE fibers twisted together, and the synthetic fibers (110) composing the core (11) are each individually twisted with 200 to 700 turns/m in a first rotation direction around a longitudinal axis and then a plurality of the twisted synthetic fibers (110) are twined together with 100 to 200 turns/m in the opposite rotation direction around the longitudinal axis.

2. The rope as recited in claim 1, wherein the synthetic yarns (100) that form the casing (10) each include 30 individual PTFE fibers with a yarn thickness of 380 dtex.

3. The rope as recited in claim 2, wherein the casing (10) is composed of 16 synthetic yarns (100) interlaced with one another.

4. The rope as recited in claim 3, wherein the core (11) is composed of synthetic fibers (110) based on polyolefins including polyethylene, polypropylene, polyamides, polyester, polytetrafluoro-ethylene (PTFE), aramide, or an ultra-high molecular weight polyethylene.

5. The rope as recited in claim 4, wherein the core (11) is composed of synthetic fibers (110) with a yarn thickness from 250 to 3,300 dtex.

6. The rope as recited in claim 5, wherein the core (11) is composed of PTFE synthetic fibers (110) with a yarn thickness from 380 to 440 dtex.

7. The rope as recited in claim 6, wherein the core is composed of 540 individually twisted synthetic fibers, 30 to 180 of which are then twined together in an opposite rotation direction.

8. The rope as recited in claim 6, wherein the rope has a diameter of 2 to 20 mm.

9. The rope as recited in claim 1, wherein the synthetic yarns (100) that form the casing (10) each include 30 individual PTFE fibers with a yarn thickness of 380 dtex.

10. The rope as recited in claim 1, wherein the casing (10) is composed of 16 synthetic yarns (100) interlaced with one another.

11. The rope as recited in claim 1, wherein the core (11) is composed of synthetic fibers (110) based on polyolefins including polyethylene, polypropylene, polyamides, polyester, polytetrafluoro-ethylene (PTFE), aramide, or an ultra-high molecular weight polyethylene.

12. The rope as recited in claim 1, wherein the core (11) is composed of synthetic fibers (110) with a yarn thickness from 250 to 3,300 dtex.

13. The rope as recited in claim 12, wherein the core (11) is composed of PTFE synthetic fibers (110) with a yarn thickness from 380 to 440 dtex.

14. The rope as recited in claim 1, wherein the core is composed of 540 individually twisted synthetic fibers, 30 to 180 of which are then twined together in an opposite rotation direction.

15. The rope as recited in claim 1, wherein the rope has a diameter of 2 to 20 mm.

* * * * *